United States Patent [19]

Delano

[11] 4,100,968

[45] Jul. 18, 1978

[54] TECHNIQUE FOR RUNNING CASING

[76] Inventor: Charles George Delano, 6449 Long Meadow, Corpus Christi, Tex. 78413

[21] Appl. No.: 718,476

[22] Filed: Aug. 30, 1976

[51] Int. Cl.[2] ..... E21B 23/00; E21B 3/02

[52] U.S. Cl. ..... 166/315; 81/72; 175/171; 294/86.15

[58] Field of Search ..... 166/315, 98, 178; 81/71, 72; 175/171, 85; 294/86.15, 88

[56] References Cited

U.S. PATENT DOCUMENTS

| | | | |
|---|---|---|---|
| 1,790,761 | 2/1931 | Ortolon | 81/72 |
| 1,917,135 | 7/1933 | Littell | 294/86.15 |
| 2,190,442 | 2/1940 | Costello | 166/98 |
| 2,633,333 | 3/1953 | Storm | 175/85 |
| 2,956,782 | 10/1960 | Mistrot | 175/85 |
| 2,984,302 | 5/1961 | Church | 294/86.15 |
| 3,149,676 | 9/1964 | Ensminger | 81/72 |
| 3,303,730 | 2/1967 | Ellis | 81/72 |
| 3,322,006 | 5/1967 | Brown | 81/72 |
| 3,380,528 | 4/1968 | Timmons | 81/72 |
| 3,570,598 | 5/1969 | Johnson | 166/178 |
| 3,664,439 | 5/1972 | Council | 175/85 |

*Primary Examiner*—James A. Leppink
*Attorney, Agent, or Firm*—G. Turner Moller

[57] ABSTRACT

There is disclosed a technique for running casing in a well in which the casing joint about to be connected to similar joints suspended in the hole is releasably grasped on the inside of the joint. The casing joint is elevated through the releasable connection made inside the casing joint and is positioned to engage the joint suspended in the hole. The two joints are placed in engagement and the elevated joint rotated to make up the threaded connection. Fluid may be pumped into the casing string to maintain pressure control after making up the joint, while lowering the casing string in the hole or before the releasable connection is broken.

19 Claims, 5 Drawing Figures

TECHNIQUE FOR RUNNING CASING

This invention comprises an improved technique for running casing in a well.

Oil field casing typically comprises a metallic piece of pipe having a central passage therethrough and threaded connections on each end. The male threads, typically called a pin, are usually machined on one end of the pipe section. The female threads, typically called a box, are either machined on the inside of the other end of the pipe or are provided by an internally threaded collar which is threaded onto male threads machined on the other end of the pipe. The latter type casing is usually denominated T&C as an abbreviation for threads and couplings while the former type is called flush joint since the outer diameter of the female end differs little if any from the outer diameter of the major part of the pipe section.

It has been conventional to run pipe in a well with the male threads lowermost so that connections made on the floor of the drilling rig comprise threading the pin of the next casing joint into the exposed box of the joint suspended in the rotary table. Although this could conceivably be reversed, no substantial advantage is seen in so doing.

The casing string is normally suspended in the well through the rotary table by a device known as slips which grasp the external surface of the casing joint and which may be either manually operated or operated with some type of power assist.

After the cementing shoe and first joint of casing are suspended in the well through the rotary table, the prior art technique comprises positioning the next joint of casing where it can be grasped on the exterior thereof by a casing elevator, elevating the casing joint with the casing elevator which is connected with the traveling block of the drilling rig, aligning the elevated joint with the casing joint suspended in the rotary table, lowering the uppermost casing joint until the pin thereof is received in the box of the suspended joint, rotating the elevated joint by grasping it on the exterior thereof, as by the use of a chain or casing tongs, thereby threadably connecting the first and second joints, disengaging the slips which act to suspend the first joint in the rotary table, lowering the rig traveling block thereby lowering the first and second joints into the well, engaging the slips to suspend the second casing joint in the well in a position where the female threads thereof are exposed, and repeating the process until as many joints as desired are run into the hole.

A typical cementing shoe contains a check valve which allows liquid passage from inside the casing to the outside thereof but which prevents reverse flow. This check valve is accordingly closed by the hydrostatic pressure of completion fluid in the hole so that the casing string remains empty. It is conventional practice to periodically attach the kelly to the casing joint extending through the rotary table to at least partially fill up the casing string to prevent its collaspse. Upon filling up the casing string, the kelly must be set back to allow the casing running operation to continue.

Should the well begin to blow out during the running of casing, as may be evidenced by mud continuing to flow into the pits after the last attached joint is lowered and suspended in the rotary table, the blow out preventer must be closed and the kelly attached to the exposed box of the last joint. Mud or other pressure control fluid is then pumped into the well in order to kill it. Since the casing string may be moved against the wall of the hole and become stuck during a blow out, it is important to rotate the casing string in order to avoid sticking. The only mechanism capable of rotating the casing string is the rotary table which typically has no means of controlling torque applied to the casing string. It is accordingly within the realm of possibility that the rotary table may over torque the casing string to such an extent that one or more of the threaded connections may fail. This is indeed a serious matter since one must commence a fishing operation after the well is killed in order to retrieve the twisted off casing section.

The provision of fishing spears having expandable slips for gripping the inside of a pipe string are shown in exemplary U.S. Pat. Nos. 2,172,481; 2,737,410 and 3,570,598. Also of interest are U.S. Pat. Nos. 2,858,892; 3,096,075 and 3,500,908.

By the use of this invention, one can fill up the casing string without taking the extra steps of connecting and disconnecting the kelly to the casing string. In a similar fashion, one can pump pressure control fluid into the casing string during the casing running operation in order to control a blow out. In the event that a blow out occurs and circulation of pressure control fluid is commenced, the casing string may be rotated at a torque level which is incapable of causing failure of the threaded connections comprising part of the casing string.

It is an object of this invention to provide an improved technique for running casing in a well bore.

Another object of this invention is to provide an improved technique for tightening casing joints by temporarily attaching a tool to the interior passage of a casing joint.

A further object of the invention is to provide an improved technique for maintaining pressure control of a well during the running of casing therein comprising pumping pressure control fluid through a tool which is used to connect the casing joints together.

In summary, one aspect of this invention comprises a method or apparatus for tightening casing joints by the use of means gripping the internal surface of the casing joint.

In summary, another aspect of the invention comprises a method or apparatus for maintaining pressure control during running of casing therein by the use of a tool which acts to connect the casing joints through which fluid may be pumped.

IN THE DRAWINGS

Figure 1:
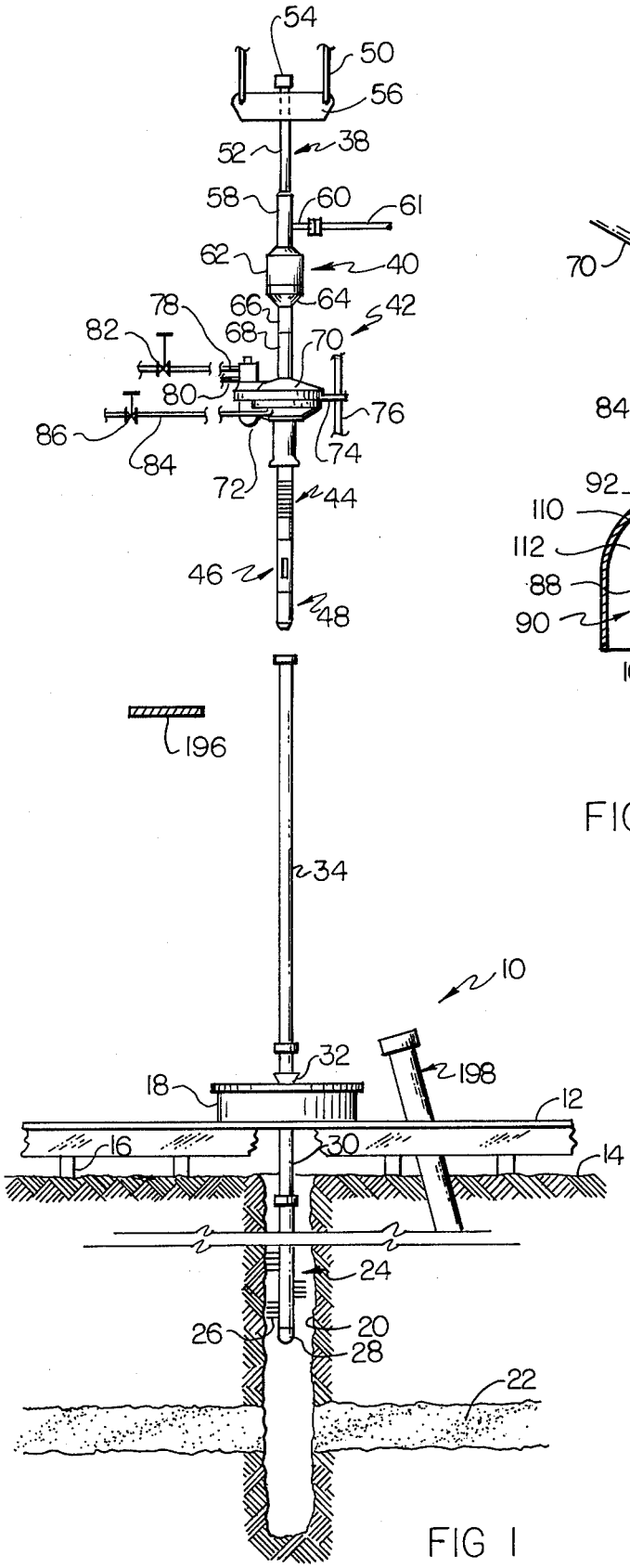
FIG. 1 is a cross-sectional view of a portion of a bore hole and drilling rig illustrating the apparatus of this invention exploded from the casing joints being worked upon.

Referring to FIG. 1, there is illustrated a drilling rig 10 comprising a floor 12 elevated above a ground surface 14 by a substructure 16 of any suitable type. The drilling rig 10 includes a rotary table 18, a derrick (not shown), a drawworks (not shown), a traveling block (not shown), and other typical equipment. A bore hole 20 is illustrated as extending into the earth and penetrating a formation 22. A tubular or casing string 24 is illustrated as extending into the bore hole 20 and is comprised of threadably connected joints of pipe of any desired size. In a conventional manner, the tubular string 24 may carry a plurality of scratchers 26, a cementing shoe 28 and other cementing equipment, such as centralizers, float equipment and the like, as may be desired during the cementing of the string 24 in the bore hole 20.

The casing string 24 includes a casing joint 30 suspended in the bore hole 20 through the rotary table 18 by a set of rig slips 32 which may be operated either manually or with a power assist. A casing joint 34 is temporarily connected to equipment 36 which is used to make up the threaded connection between the joints 30, 34, to lower the casing string 24 into the well bore 20 to a position where the slips 32 grasp the casing joint 34 and to pump mud or other completion fluid into the casing string 24 as desired.

The equipment 36 comprises as major components a lift device 38, a swivel 40, a rotating tool 42, a slips section 44, a dog or tong section 46, and a seal section 48. As will be more fully apparent hereinafter, the equipment 36 may be manipulated to either simultaneously or sequentially rotate and reciprocate the casing string 24 by energizing the rotating tool 42 in conjunction with raising and lowering of the lift device 38 by a pair of bails 50 carried on the traveling block (not shown) of the drilling rig 10.

The lift device 38 may be of any suitable type and is illustrated as a solid sub 52 threaded into the top of the swivel 40 and having an enlargement 54 on the upper end thereof capativated by a set of elevators 56.

The swivel 40 may be of any suitable type such as illustrated in U.S. Pat. No. 3,777,819, to which reference is made for a more complete description thereof. The swivel 40 conveniently comprises a conduit 58 threadably receiving the sub 52 of the lift device 38 and having a fluid inlet 60 to which is attached a mud line 61 for delivering pressurized liquid into the casing string 24 as will be more fully explained hereinafter. The swivel 40 comprises a stationary portion 62 rigid with the conduit 58 and a rotatable portion 64. Extending from the bottom of the rotatable portion 64 is a conduit 66 in fluid communication with the inlet 60.

The rotating tool 42 may be of any desired type so long as it has operating characteristics commensurate with its desired functions. As will be more fully apparent hereinafter, the rotating tool 42 transmits liquid or slurries pumped into the fluid inlet 60 toward the casing string 24, allows reciprocation of the equipment 36 through a substantial stroke and rotates the casing joint 34 and/or the entire casing string 24 at desired torque and speed levels. One particular device that has proved satisfactory is a power sub manufactured by Bowen Tools, Inc., Houston, Tex., as is described in an instructural manual printed in December 1965, to which reference is made for a more complete description thereof. An important feature of the rotating tool 42 is the ability to control the torque applied to a value less than the joint strength of the couplings constituting the string 24.

The rotating tool 42 comprises a conduit 68 threadably attached at the upper end thereof to the rotatable swivel portion 66 and threadably attached at the lower end thereof to the slips sections 44. A housing 70 encloses a gear wheel (not shown) operatively connected to the conduit 68 and driven by a hydraulic motor 72. The housing 70 includes an aperatured bracket 74 receiving a stationary guide 76 therethrough to prevent rotation of the housing 70 in a direction opposite from that of the conduit 68. It will accordingly be seen that the rotating tool 42 is constrained for vertical movement by the guide 76 which acts to assure that the conduit 68 is rotated rather than the housing 70. The motor 72 is provided with suitable hydraulic lines 78, 80 for delivering and returning power fluid from the motor 72 to a suitable pump (not shown). Suitable controls such as a valve 82 and pressure gauges (not shown) are provided as desired in order to limit the amount of torque applied by the rotating tool 42 to the casing joint 34 or to the casing string 24 to a value less than the joint string of the couplings comprising the joint 24.

Figure 2:
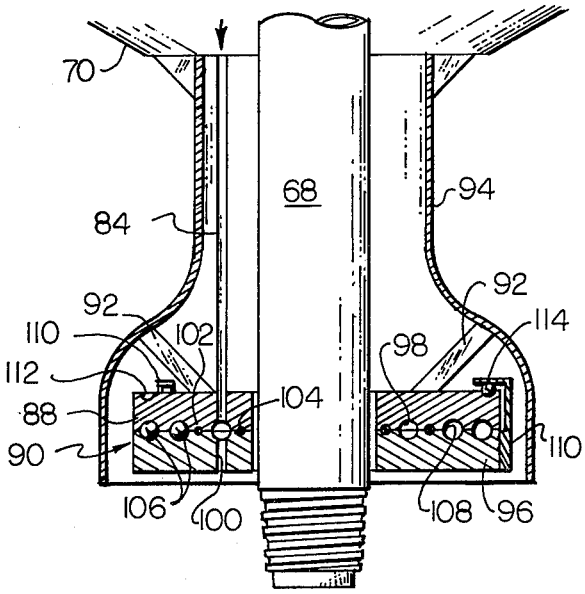
FIG. 2 is an enlarged partial longitudinal cross-sectional view of a lower portion of a power rotating tool.

Referring to FIG. 2, there is illustrated a modification to the rotating tool 42 which allows the supply of control fluid to the slips section 44. As will be more fully pointed out hereinafter, the slips section 44 is conveniently air actuated thereby requiring the use of suitable piping to deliver and return control air. To this end, the rotating tool 44 carries a conduit 84 leading to a suitable control panel (not shown) having a valve 86 therein. The conduit 84 terminates in a stationary part 88 of an air distribution ring 90. The stationary part 88 is conveniently attached by suitable braces 92 to a shroud 94 rigidly connected to the bottom of the housing 70. The air distribution ring 90 further comprises a rotatable part 96 which, together with the stationary part 88, provides an air distribution groove 98 from which an outlet 100 extends through the rotatable part 96 in fluid communication with passageways in the slips section 44. Suitable seals, such as concentric O-rings 102, 104, are provided between the parts 88, 96 along with suitable bearings 106 operating in one or more bearing grooves 108. A plurality of hangers 110 support the rotatable part 96 from the stationary part 88 while allowing relatively free rotation as provided by a bearing groove 112 and suitable bearings 114.

Figure 3:
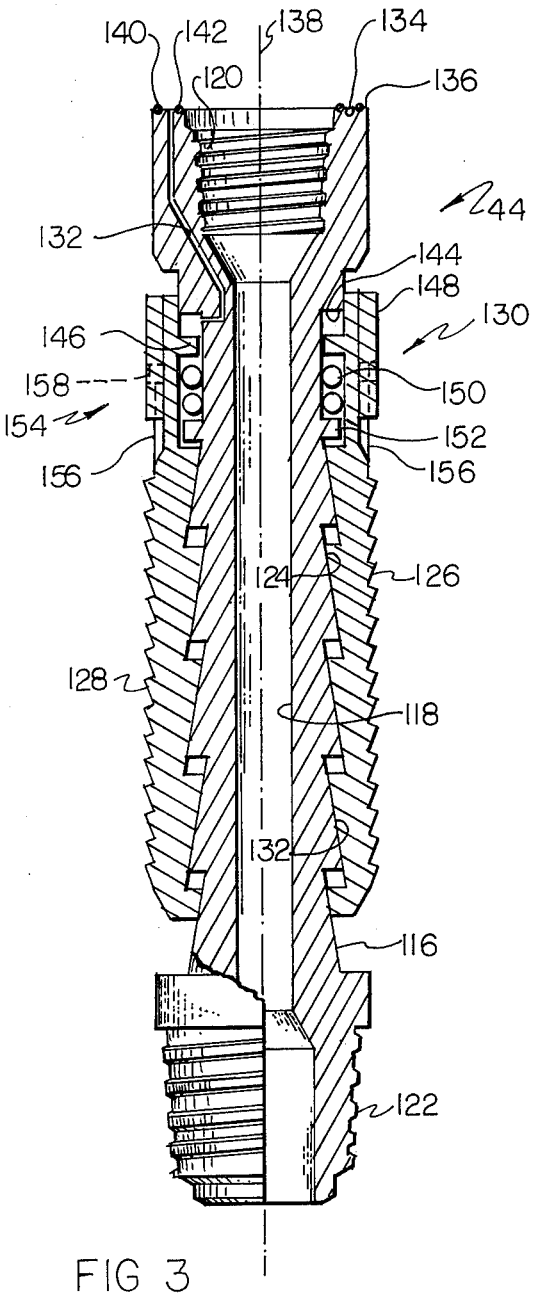
FIG. 3 is an enlarged longitudinal view of a slip section used to suspend and elevate a casing joint.

Referring to FIG. 3, the slips section 44 comprises a spear body 116 having a central passage 118 therethrough providing communication for liquids and slurries pumped into the fluid inlet 60. The spear body 116 provides upper female threads 120 for connection to the conduit 68 and lower male threads 122 for connection to the tong section 46. The body 124 provides a plurality of generally frustoconical sections 124 which act to cam a plurality of slip segments 126, 128 outwardly upon manipulation of the control means 130. The control means 130 comprise a passage 132 in the body 116 which exits longitudinally therefrom through a groove 134 in the upper face 136 of the body 116. The groove 134 is spaced radially from the axis 138 to register with the outlet 100 of the air distribution ring 90. Suitable seals, such as concentric O-rings 140, 142, provide a seal around the groove 134 between the upper face 136 and the bottom of the rotating part 96. The passage 132 exits radially from the body 116 in a recess 144 in which is positioned a piston 146 rigidly mounted on a slip cage 148. It will be apparent that the piston 146 and consequently the slip cage 148 move downwardly in response to the delivery of pressurized air into the chamber afforded by the recess 144.

Upon downward movement of the piston 144, a spring 150 is compressed against an anvil 152 rigid with the spear body 116. Upon the exhaustion of pressurized air from the recess 144, the spring 150 is sufficient to elevate the slip cage 148 and consequently elevate the slip segments 126, 128 through a moveable connection 154. The moveable connection 154 may be of any suitable type and conveniently comprises a shank 156 rigid with the slip sections 126, 128 having an enlarged head thereon captivated in a dove-tailed slot 158 in the slip cage 148. It will accordingly be apparent that movement of the slip cage 148 in a generally vertical direction causes generally lateral movement of the slips sections 126, 128 because of the frusto-conical camming surfaces 124.

Figure 4:
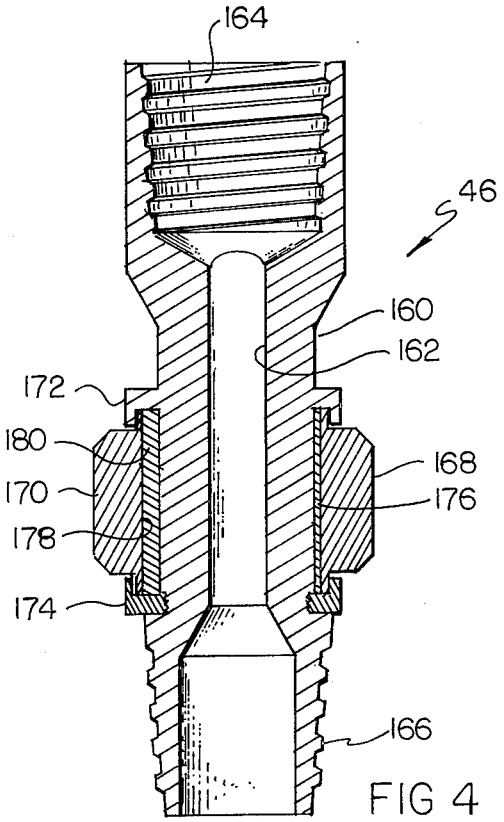
FIG. 4 is an enlarged longitudinal cross-sectional view of a dog section which acts to transmit rotation provided by the powered rotating tool into rotation of a casing joint.
Figure 5:
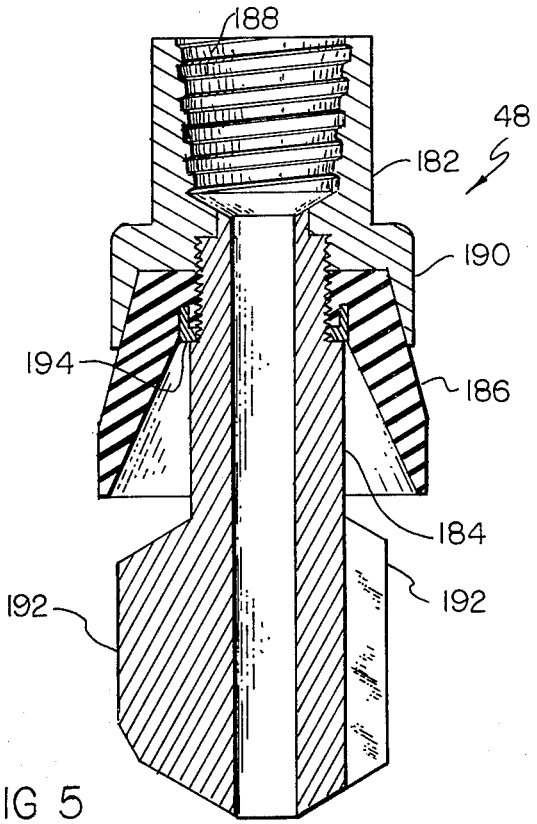
FIG. 5 is an enlarged longitudinal cross-sectional view of a seal section used in the control of pressurized fluid.

Referring to FIG. 4, the tongs section 46 comprises a body 160 having a central passage 162 therethrough and providing upper female threads 164 for connection to the slips section 44 and lower male threads 166 for connection to the seal section 48. The tong section 46 carries a plurality of tong dies 168, 170 captivated by upper and lower overhanging lips 172, 174. The tong dies 168, 170 comprises a radially inner surface 176, 178 abutting a cam member 180. It will accordingly be seen that the tong dies 168, 170 are radially advanced into an engagement with the inner surface of the casing section 34 by relative rotation of the body 160 and cam 180 relative to the tong dies 168, 170. It will accordingly be apparent that the tong dies 168, 170 and the camming mechanism 180 therefore are substantially identical to the tong section of a packer made by Brown Oil Tools, Houston, Tex. as shown on page 765 of the Composite Catalog of Oil Field Equipment and Services, 1974–75 edition.

The seal section 48 comprises an upper body section 182 threadably connected to a lower body section 184 and captivating therebetween a packer or seal 186. The upper body section 182 provides female threads 188 for connection to the tong section 46 and a cylindrical skirt or packer thimble 190 for engaging the periphery of the seal 186. The lower body section 184 provides a plurality, for example three, of guides 192 for centering the assembly as it is stabbed into the casing joint 34. The seal 186 is captivated against the skirt 190 in any suitable fashion, as by the use of a compression nut 194. It will be apparent that the seal section 48 is substantially similar to a Spear Pack-Off Assembly made by Bowen and illustrated on page 647 of the Composite Catalog of Oil Field Equipment and Services, 1974–75 edition.

In use, with the casing joint 30 suspending through the rotary table 18 by the rig slips 32, the next casing joint 34 is picked up and stabbed into the box of the casing joint 30 in any suitable manner. This may, for example, be accomplished by a line (not shown) attached to the traveling block (not shown) to what is known as the cowcock (not shown) and looped about the box end of the joint 34. Upon raising the traveling block, the joint 34 is lifted out of the V-door (not shown) to a vertical position above the casing joint 30. The joint 34 is then lowered toward the rotary 18 in alignment with the joint 30. An individual standing on a stabbing board 196 supported by the derrick (not shown) may assist in stabbing the joint 34.

After the joint 34 is stabbed into the exposed box of the joint 30, the traveling block is lowered and the individual standing on the stabbing board 196 assists in stabbing the guides 192 of the seal section 48 into the exposed box of the joint 34. The traveling block is further lowered until the slips section 44 enters the joint 34 and is positioned below the female threads in the exposed box.

Control air is admitted by manipulation of the valve 86 into the conduit 84 thereby moving the piston 146 downwardly which results in lateral movement of the slip segments 126, 128 thereby temporarily connecting the equipment 36 to the interior surface of the joint 34. With the slip segments 126, 128 set, hydraulic fluid is delivered through the conduits 78, 80 to drive the motor 72 and thereby rotate the conduit 68. Rotation of the conduit 68 causes the tong body 160 to rotate. Since the cam 180 tends to rotate with the tong body 160, the tong dies 168, 170 are radially advanced into engagement with the inner surface of the casing joint 34 thereby causing the joint 34 to commence rotation. Rotation of the casing joint 34 acts to make up the threaded connection between the threaded joints 30, 34.

When the threads coupling the joints 30, 34 are made up, the rig slips 32 are disengaged from the rotary 18 and the traveling block (not shown) is allowed to descend thereby advancing the casing joint 34 into the well bore 20. When the box end of the joint 34 approaches the top of the rotary table 18, the rig slips 32 are set to suspend the casing string 24 in the rotary table 18. By exhausting control air to the atmosphere through the conduit 84 and the valve 86, the pressure in the recess 144 decreases substantially. The slip segments 126, 128 do not immediately retract because of the load thereon. When the traveling block (not shown), is allowed to lower slightly and take the weight off the slip segments 126, 128, the spring 150 elevates the slip cage 148 and consequently the slip segments 126, 128 thereby retracting the same and disconnecting the slips section 44 from inside the casing joint 34. Driving the rotating tool 42 a very short distance in the unthreading direction causes relative rotation between the tong body 160 and the cam 180 thereby allowing the tong dies to loosen from engagement with the inside of the casing joint 34. The equipment 36 is then free to move out of the casing joint 34 when the traveling block is raised. It will be apparent that the process of running casing joints in the hole 20 may be repeated until the casing string 24 is of a desired length.

If it is desired to fill up the casing string 24, mud or other suitable completion liquid is delivered through the mud line 61, the fluid inlet 60, the conduit 68, the passage 118 in the slips section 44, the passage 162 in the tong section 46 and the passage extending through the seal section 48. The seal 186 of the seal section 48 prevents mud from flowing upwardly out of the joint 34 onto the rig floor 12. It will be apparent that mud can be pumped into the casing string 24 at any time commencing with the making up of the threads coupling the joints 30, 34 together and ending with the removal of the equipment 36 from inside the casing joint 34.

In the event the well should begin to blow out during the running of casing, it is apparent that the rams of the blowout preventer (not shown) may be closed about the exterior of the casing joint adjacent thereto. At any time when the equipment 36 is inserted in the casing joint 34, pressure control fluid can be pumped into the mud line 61 and consequently into the hole 20 in an attempt to bring the blowout under control. Consequently, pressure control fluid can be pumped into the hole 20 most of the time during casing running operations. Even if the blowout commences when the equipment 36 is out of the casing joint 34, as when picking up an additional joint of pipe from the V-door (not shown), the equipment 36 can be stabbed into the exposed box without requiring the connection or disconnection of the kelly.

In the event the well begins to blow out when the equipment 36 is inserted in the casing joint 34, immediate pumping of mud may be commenced. Until the blowout preventer rams are closed, rotation of the casing string 24 can be effected by the rotating tool 42.

After the casing string 24 is run into the hole 20 for its desired length, circulation of mud or other suitable material may be commenced to condition the wall of the bore hole 20 in preparation for cementing. It will be apparent that the slips section 44, tong section 46 and seal section 48 need not be removed from the last casing joint run into the hole.

It will likewise be apparent that the casing joint 24 may be simultaneously or sequentially rotated and reciprocated in order to obtain an improved bond between the casing string 24, the cement sheath, and the wall of the bore hole 20. It will be apparent that this rotation may be effected by the rotating tool 42 acting through the tong section 46 while the reciprocation can be effected by the traveling block acting through the slips section 44.

Rather than elevating and aligning the casing joint 34 with a line connected to the traveling block as previously described, it is apparent that mouse hole connections can be made with the equipment 36. As is known by those skilled in the art a mouse hole 198 is a large joint of pipe extending from adjacent the rotary 18 through the rig floor 12 into the earth's surface 14 if the rig 10 is a conventional. A joint of casing may be placed in the mouse hole 198 by an suitable means, for example, the previously described line on the traveling block or a catline. With a joint of casing in the mouse hole 198, the traveling block may be lowered until the seal guides 192 can be stabbed into the open end of the casing joint. After setting the slip segments 126, 128, the casing joint can be lifted out of the mouse hole 198 and raised into alignment with the casing joint 32.

I claim:

1. A method of making up pipe joints, each having an internal passage providing an intermediate unthreaded internal surface, an end female threaded section and an end male threaded section, adjacent a rotary table on a drilling rig and running the pipe in a well, comprising temporarily vertically suspending a first pipe joint through the rotary table in a position with one of the threaded sections exposed;

engaging and connecting the intermediate unthreaded internal surface of a second pipe joint with a tool and defining an open annulus between the tool and second joint;

positioning the second pipe joint above and in alignment with the first joint by the use of the tool;

lowering the second joint into threading engagement with the exposed threaded section of the first joint;

relatively rotating the first and second joints through the tool connection for making up the threaded sections thereby connecting the first and second joints;

pumping fluid through the tool into the connected pipe joints while the tool and pipe joints are connected;

sealing the annulus between the tool and second pipe joint for directing all fluid into the pipe joint;

releasing the first joint from suspension through the rotary table;

lowering the first and second joints through the rotary table into the well through the tool connection; and temporarily vertically suspending the second joint through the rotary table in a position with one of the threaded sections exposed.

2. The method of claim 1 further comprising disengaging and releasing the tool connection with the intermediate unthreaded internal surface of the second joint;

positioning a third casing joint above and in alignment with the second joint;

lowering the third joint into threading engagement with the exposed threaded section of the second joint;

connecting the intermediate unthreaded internal surface of the third joint with a tool;

relatively rotating the second and third joints through the tool connection for making up the threaded sections thereby connecting the second and third joints;

releasing the second joint from suspension through the rotary table;

lowering the second and third joint through the rotary table into the well; and temporarily vertically suspending the second joint through the rotary table in a position with one of the threaded sections exposed.

3. The method of claim 1 wherein the rotating step comprises rotating the second pipe joint through the tool connection.

4. The method of claim 1 wherein the connecting step occurs immediately after lowering the second joint into threading engagement with the first joint.

5. A method of maintaining pressure control of a well during running therein of pipe joints having an internal passage therethrough, an intermediate unthreaded internal surface, an end female threaded section and a male threaded section, comprising temporarily connecting a tool having a passageway therethrough to the intermediate unthreaded internal surface of a first pipe joint in fluid exchanging relation with the internal passage and defining an open annulus between the tool and the first pipe joints;

connecting the first pipe joint to a second pipe joint with the tool;

pumping fluid through the tool into the connected pipe joints while the tool and pipe joints are connected; and sealing the open annulus.

6. The method of claim 5 wherein the connecting step comprises rotatably tightening the threaded sections of the first and second pipe joints.

7. The method of claim 6 wherein the connecting step comprises setting slips against the unthreaded internal surface of the one pipe joint with the tool.

8. The method of claim 7 wherein the sealing step includes sealing between the tool and the internal surface of the pipe joint for directing all fluid into the pipe joints.

9. Apparatus for tightening casing joints, each having an internal passage providing an intermediate unthreaded internal surface, an end female threaded section and an end male threaded section, above a rotary table carried on a drilling rig, comprising a swivel having a relatively stationary part for suspension from the drilling rig and a relatively rotatable part;

powered rotating tool suspended from the swivel having a member depending therefrom for less than the length of one joint and means for rotating the member;

means connected to the member for grasping the intermediate unthreaded internal surface of the casing joint for suspending, rotating and tightening the threaded sections of adjacent joints; and means for sealing between the member and the casing joint for directing fluid therethrough.

10. The apparatus of claim 9 wherein the connecting means comprises a mechanism insertable into the casing joint providing means for gripping the internal surface of the casing joint for suspending the same; and means for transmitting rotation of the mechanism into rotation of the casing joint.

11. The apparatus of claim 10 wherein the swivel comprises a fluid inlet on the stationary part thereof and a fluid passage communicating with the fluid inlet;

the rotating tool provides a passage in fluid exchanging relation with the swivel passage; and the mechanism provides a passage in fluid exchanging relation with the tool passage.

12. The apparatus of claim 11 wherein the sealing means comprises means for sealing between the mechanism and the internal surface of the casing joint for directing fluid therethrough.

13. The apparatus of claim 12 wherein the gripping means comprises a plurality of slip segments and means mounting the slip segments for generally radial movement into and out of engagement with the internal surface of the casing joint; and fluid control means for selectively moving the slip segments.

14. The apparatus of claim 13 wherein the fluid control means comprises a piston operatively connected to the slip segments and means for delivering pressurized fluid to the piston for moving the same in a slip expanding direction.

15. The apparatus of claim 14 wherein the fluid control means further comprises a spring compressed during movement of the piston in a slip expanding direction for moving the slip segments in a slip retracting direction upon release of the pressurized fluid.

16. Apparatus for maintaining pressure control of a well during running therein of casing joints having an internal passage therethrough including an unthreaded section, comprising a powered tool having a member depending therefrom for less than the length of one joint connectible to the unthreaded passage section for making up the casing joints;

means for pumping a fluid into the casing joints through the making up means while connected to the casing joints; and means for sealing between the member and the casing joint.

17. The apparatus of claiam 16 wherein the casing joints comprise threaded sections at opposite ends thereof and the making up means comprises means for threadably advancing one casing joint into threading engagement with another casing joint.

18. The apparatus of claim 17 wherein the making up means comprises slips insertable into the unthreaded passage section of the casing joints for gripping the same.

19. The apparatus of claim 18 wherein the sealing means comprises means for annularly sealing between the mechanism and the internal casing passage.

* * * * *